United States Patent [19]

Chang

[11] Patent Number: 4,973,548

[45] Date of Patent: Nov. 27, 1990

[54] PHOTOGRAPHIC SILVER BROMOIODIDE EMULSIONS, ELEMENTS AND PROCESSES

[75] Inventor: Elizabeth P. Chang, Webster, N.Y.

[73] Assignee: Eastman Kodak Company, Rochester, N.Y.

[21] Appl. No.: 229,371

[22] Filed: Aug. 5, 1988

[51] Int. Cl.[5] ..... G03C 1/02

[52] U.S. Cl. ..... 430/569; 430/567; 430/543

[58] Field of Search ..... 430/569, 567, 543

[56] References Cited

U.S. PATENT DOCUMENTS

| | | | |
|---|---|---|---|
| 3,271,157 | 6/1966 | McBride . | |
| 3,505,068 | 4/1970 | Beckett et al. | 430/567 |
| 3,574,628 | 4/1971 | Jones | 430/ |
| 3,737,313 | 6/1973 | Rosecrants et al. | 430/ |
| 4,046,576 | 9/1977 | Terwilliger et al. | 430/569 |
| 4,248,962 | 2/1981 | Lau | 430/382 |
| 4,284,717 | 8/1981 | Toya et al. | 430/567 |
| 4,433,048 | 2/1984 | Solberg et al. | 430/434 |
| 4,704,351 | 11/1987 | Takiguchi et al. | 430/567 |
| 4,720,452 | 1/1988 | Takiguchi et al. | 430/567 |

OTHER PUBLICATIONS

*Research Disclosure,* Dec. 1978, Item 17643.

*The Journal of Photographic Science,* 1978, vol. 26, pp. 189–193.

*Primary Examiner*—Paul R. Michl

*Assistant Examiner*—Thomas R. Neville

*Attorney, Agent, or Firm*—Richard E. Knapp

[57] ABSTRACT

A photographic silver bromoiodide emulsion comprises a dispersing medium and a silver bromoiodide that (a) is monodispersed, cubic grain silver bromoiodide; (b) has a grain size within the range of 0.1 to 0.7 micron; (c) contains 1 to 7 mole percent iodide; and, (d) is prepared by a process comprising (i) forming the silver bromoiodide grains by mixing, in the presence of a thioether ripening agent, silver salt and alkali metal bromide and iodide salts until 60 to 90% of the silver salts have been added; then, (ii) carrying out the remainder of the silver bromoiodide grain formation with the addition of silver salt and alkali metal bromide and iodide salts that are no more than 1 mole percent iodide; wherein the resulting silver bromoiodide grains have no discernible shell as analyzed by x-ray diffraction. Such photographic silver bromoiodide emulsions are useful in photographic silver halide materials to provide longer exposure latitude.

18 Claims, No Drawings

PHOTOGRAPHIC SILVER BROMOIODIDE EMULSIONS, ELEMENTS AND PROCESSES

This invention relates to photographic silver bromoiodide emulsions, photographic elements incorporating these emulsions, and processes for the use of the photographic elements.

Photographic emulsions useful in photography typically comprise a dispersing medium, such as gelatin, containing grains of photographic silver halide. Emulsions other than silver bromoiodide emulsions have found only limited use in camera speed photographic elements. Silver bromoiodide emulsions and their preparation are described in, for example, such standard texts as Duffin, Photographic Emulsion Chemistry, Focal Press, 1966 and Mees and James, The Theory of the Photographic Process, MacMillan Publishing Co., 4th Edition, 1977.

Photographic silver bromoiodide emulsions having various grain sizes and shapes are also known in photography. Illustrative emulsions containing silver bromoiodide grains are described in, for example, U.S. Pat. Nos. 4,433,048; 4,720,452; 3,505,068; and 4,704,351.

Photographic silver bromoiodide emulsions that have cubic silver bromoiodide grains are also known, such as described in U.S. Pat. No. 4,284,717.

Small grain, monodispersed silver halide emulsions are also known. Such emulsions are known to have advantages, such as enabling more uniform chemical sensitization thereby enabling more uniformity of sensitometric response. Such emulsions also enable improved granularity and sharpness in a photographic element. However, a problem has been encountered with such emulsions because the improved granularity is observed only with higher contrast image results. The higher contrast has been undesirable because the emulsion does not enable the longer exposure latitude that is desirable, articularly in camera speed color photographic silver halide materials, such as color negative photographic silver bromoiodide materials.

It has been found that such requirements for longer exposure latitude are satisfied by a photographic silver bromoiodide emulsion comprising a dispersing medium, particularly gelatin or gelatin derivative, and silver bromoiodide that (a) is monodispersed, cubic grain silver bromoiodide; (b) has a grain size within the range of 0.1 to 0.7 micron; (c) contains 1 to 7 mole percent iodide; and, (d) is prepared by a process comprising (i) forming the silver bromoiodide grains by mixing, in the presence of a thioether ripening agent, a silver salts, particularly silver nitrate, and alkali metal bromide salts and iodide salts until 60 to 90 mole percent of the silver salts have been added; then, (ii) carrying out the remainder of the silver bromoiodide grain formation with the addition of silver salt, particularly a water soluble silver salt, preferably silver nitrate, and alkali metal bromide and iodide salts that are no more than 1 mole percent iodide; wherein the resulting silver bromoiodide grains have no discernible shell as analyzed by x-ray diffraction. Preferably no iodide salts are added in step (ii) as described. The resulting silver bromoiodide grains have iodide substantially uniformly distributed within the grains.

Another aspect of the invention is a photographic element, particularly a color photographic element, comprised of a support bearing at least one photographic silver bromoiodide emulsion layer as described herein.

A further aspect of the invention is a method of preparing the described silver bromoiodide emulsion as described including the steps of (i) forming the silver bromoiodide grains by mixing, in the presence of a thioether ripening agent, silver salts, particularly silver nitrate and alkali metal bromide and iodide salts until 60 to 90 mole percent of the silver salts have been added; then, (ii) carrying out the remainder of the silver bromoiodide grain formation with the addition of silver salts, particularly silver nitrate and alkali metal bromide and iodide salts that are no more than 1 mole percent iodide; wherein the resulting silver bromoiodide grains have no discernible shell as analyzed by x-ray diffraction. The silver bromoiodide grains resulting from the process are monodispersed cubic grains having a grain size within the range of 0.1 to 0.7 micron.

A further aspect of the invention is directed to forming a visible photographic image, particularly a color photographic image, by a process comprising processing an exposed photographic element as described herein in an aqueous alkaline solution in the presence of a photographic developing agent, particularly a color photographic silver halide developing agent.

The described invention enables unique and unexpected advantages. The described emulsion, element and process enable the extension of latitude of exposure without sacrificing the advantages of a monodispersed silver bromoiodide emulsion having cubic grains as demonstrated in the following comparative examples. The described emulsions are particularly advantageous when chemically sensitized and spectrally sensitized and in color photographic materials designed to form dye images. The described emulsions, elements and processes enable significantly improved color images, especially images that have particularly useful sharpness and speed grain relationship.

The term monodispersed herein means that at least 95%, such as 95 to 99 9%, by weight of the silver bromoiodide grains less than the mean grain diameter and at least 95%, such as 95% to 99.9%, by number of the silver bromoiodide grains larger than the mean grain diameter must be within 40% of the mean grain diameter. The mean grain diameter means the diameter of a circle equal in area to the mean projected area of the silver bromoiodide grains, especially as viewed in a photomicrograph or an electronmicrograph of an emulsion sample.

The cubes formed may have rounded corners and rounded edges.

The grain size and characteristics of the silver bromoiodide grains as described can be readily ascertained by procedures well known in the photographic art. In some instances a concentration of silver halide grains that are not cubic grains can be present in the emulsion and element of the invention without adversely affecting the required properties of the silver bromoiodide monodispersed cubic grain emulsion of the invention.

The silver bromoiodide emulsion of the invention is prepared by controlling the introduction of iodide salts in the precipitation process without removing the thioether ripening agent during the entire process. Processes that do not enable the ripening agent to be present during the entire process do not form the silver bromoiodide grains of the present invention.

In the process of preparing a silver bromoiodide according to the invention typically a dispersing medium, preferably an aqueous gelatin or a gelatin derivative composition, is introduced into a conventional reaction vessel designed for silver halide precipitation equipped with an efficient stirring mechanism. Typically the dispersing medium is introduced into the reaction vessel in a concentration that is at least about 10%, preferably 20 to 80%, by weight based on the total weight of the dispersing medium present in the silver bromoiodide emulsion at the conclusion oF grain precipitation. The volume of dispersing medium initially present in the reaction vessel can equal or exceed the volume of the silver bromoiodide emulsion present in the reaction vessel at the conclusion of the conclusion of the grain precipitation. The dispersing medium introduced into the reaction vessel is preferably a dispersion of peptizer in water, particularly gelatin in water, optionally containing other ingredients, such as silver halide ripening agents and/or metal dopants. The peptizer, particularly gelatin or a gelatin derivative, is preferably initially present in a concentration of at least 10%, preferably at least 20%, of the total peptizer present at the completion of the silver bromoiodide precipitation. Additional dispersing medium can optionally be added to the reaction vessel with the silver salts and the alkali metal bromide and iodide salts and also can be introduced through a separate inlet means, such as a separate jet. The proportion of dispersing medium can be adjusted after the completion of the salt introductions or after washing.

During precipitation silver salts, preferably silver nitrate, bromide salts, preferably alkali metal bromide salts, and iodide salts, preferably alkali metal iodide salts, are added to the reaction vessel by techniques known in the photographic silver bromoiodide emulsion making art. Typically an aqueous silver salt solution, preferably a silver nitrate solution, is introduced into the reaction vessel concurrently with the introduction of bromide alone or bromide and iodide salts. The bromide and iodide salts are typically introduced as aqueous salts solutions, preferably as aqueous solutions of one or more alkali metal, such as potassium or sodium, salts. Alkaline earth metal salts can also be useful, such as calcium and magnesium salts. The silver salt is introduced into the reaction vessel separately from the halide salt. The iodide and bromide salts can be added to the reaction vessel separately or as a mixture.

With the introduction of the silver salts into the reaction vessel the nucleation stage of grain formation is initiated. A population of grain nuclei are formed that are capable of serving as precipitation sites for silver bromide and silver iodide as the introduction of silver, bromide and iodide salts continues. The precipitation of the silver bromide and silver iodide onto the existing grain nuclei constitutes the growth stage of grain formation. The permissible latitude of pBr during the growth stage of the precipitation is within the range of 2.5 to 6, preferably within the range of 2.5 to 4. A highly preferred pBr is 3.2. The PBr can be regulated during the precipitation.

Subject to the requirements of the process as described above the concentrations and rates of silver salt, bromide salt and iodide salt introductions can take any convenient and conventional form useful for forming cubic silver bromoiodide emulsions. The silver and halide salts are preferably introduced in concentrations within the range of 0.1 to 5 moles per liter. The rate of silver and halide salt introduction can be constant or optionally increased either by increasing the rate at which the silver and halide salt are introduced or by increasing the concentrations of the silver and halide salts being introduced. It is preferred to increase the rate of silver and halide salt introduction, but to maintain the rate of introduction below that at which the formation of new grain nuclei is favored to avoid renucleation. The concentration of iodide in step (ii) must be less than the concentration of iodide in step (i) as described.

The process of preparing the silver bromoiodide is preferably carried out at a temperature within the range of 25° to 80° C., such as about 45° C.

The iodide concentration in the monodispersed, cubic silver bromoiodide grains according to the invention is substantially evenly distributed throughout the grain as a result of the described method of preparing the grains. No core of silver iodide or shell of silver iodide is observed in the grains. This can be determined by x-ray diffraction techniques known in the art.

Modifying compounds can be present during the silver bromoiodide precipitation. Such compounds can be initially in the reaction vessel or can be added with one or more of the salts according to conventional emulsion making procedures. Modifying compounds, such as compounds of copper, iridium, thallium, lead, bismuth, cadmium, zinc, middle chalcogens, such as sulfur, selenium and tellurium, gold, Group VIII noble metals, can be present during the precipitation, as described in, for example, U.S. Pat. No. 4,433,048 and the art described therein.

The individual silver and halide salts can be added to the reaction vessel through surface or subsurface delivery tubes, by gravity feed or delivery apparatus for maintaining control of the rate of delivery and the pH, pBr, and/or pAg of the reaction vessel contents as is used in the art of photographic emulsion making.

In forming the silver bromoiodide emulsions a dispersing medium preferably comprises in the reaction vessel initially an aqueous peptizer suspension. The peptizer concentration is typically within the range of 0.2 to 10% by weight, based on the total weight of the emulsion components in the reaction vessel. Typically the concentration of peptizer in the reaction vessel is maintained below about 6%, based on the total weight, prior to and during silver halide formation. The emulsion vehicle concentration is typically adjusted upwardly for optimum coating characteristics by delayed, supplemental vehicle additions. Typically the emulsion as initially formed contains peptizer within the range of about 5 to about 50 grams of peptizer per mole of silver halide, preferably about 10 to about 30 grams of peptizer per mole of silver halide. Additional vehicle can be added later to bring the concentration up to as high as 1000 grams per mole of silver halide. Preferably the concentration of vehicle in the finished emulsion is above 50 grams per mole of silver halide. When coated and dried on a support forming a photographic element, the vehicle preferably comprises about 30 to about 70% by weight of the emulsion layer.

Vehicles, including both binders and peptizers, can be selected from those conventionally employed in photographic silver halide emulsions. Preferred peptizers are hydrophilic colloids, that can be used alone or in combination with hydrophobic materials. Useful hydrophilic materials include both naturally occurring substances, such as proteins, protein derivatives, cellulose derivatives, such as cellulose esters, gelatin, such as alkali treated gelatin or acid treated gelatin, gelatin derivatives, such as acetylated gelatin and phthalated gelatin, polysaccharides, such as dextran, gum arabic, zein, casein, pectin, collagen derivatives, agar-agar, arrowroot and albumin and other vehicles and binders known in the photographic art. Gelatin is highly preferred.

Other materials commonly used in combination with hydrophilic colloid peptizers as vehicles, including for example vehicle extenders such as materials in the form of latices, are also useful in the emulsions of the invention, such as synthetic polymeric peptizers, carriers and/or binders, such as poly(vinyl lactams), acrylamide polymers, poly(vinyl alcohol) and its derivatives, poly(vinyl acetals), polymers of alkyl and sulfoalkyl acrylates and methacrylates, hydrolyzed poly(vinyl acetates), polyamides, poly(vinyl pyridine), acrylic acid polymers, maleic acid copolymers, vinyl amine copolymers, methacrylic acid copolymers, acryloyloxyalkylsulfonic acid copolymers, sulfoacrylamide copolymers, polyalkyleneimine copolymers, polyamines, N,N-dialkylaminoalkyl acrylates, vinyl imidazole polymers and copolymers, vinyl sulfide copolymers, halogenated styrene polymers, amineacrylamide polymers, polypeptides and other vehicles and binders known to be useful in the photographic art, such as described in U.S. Pat. No. 4,433,048. These added materials need not be present in the reaction vessel during the silver halide precipitation, but rather are typically added to the emulsion prior to coating on the support. The vehicles and binders, including the hydrophilic be employed alone or in combination not only in the emulsion layers of the photographic element, but also can be used alone or in combination in other layers, such as overcoat layers, interlayers, and layers positioned between the emulsion layers and the support.

Grain ripening is an important aspect of the preparation of an emulsion according to the invention. The thioether ripening agent can be added at the beginning of the silver bromoiodide grain formation or optionally at the start of grain growth. The term "in the presence of the thioether ripening agent" herein includes both addition aspects of the preparation. Known thioether ripening agents for preparing silver halide emulsions are used in preparing the silver bromoiodide emulsion of the invention. Thioether ripening agents that are known to promote cubic grain formation are preferred. While a preferred thioether ripening agent is a dithioether ripening agent, such as 1,8-dihydroxy-3,6-dithiooctane, other thioether ripening agents are useful. Useful thioether ripening agents include, for example, those described in U.S. Pat. Nos. 3,271,157; 3,574,628 and 3,737,313, the disclosures of which are incorporated herein by reference.

The silver bromoiodide emulsions are preferably washed to remove soluble salts. Any of the processes and compositions known in the photographic art for this purpose are useful for washing the silver bromoiodide emulsions of the invention. The soluble salts can be removed by decantation, filtration, and/or chill setting and leaching, coagulation washing, by centrifugation, and by other methods and means known in the photographic art.

If desired the silver bromoiodide emulsion of the invention can be blended or otherwise combined with other photographic silver halide emulsions if required. The photographic silver bromoiodide emulsion can be, for example, combined with a tabular grain silver halide emulsion, such as one described in U.S. Pat. No. 4,433,048.

The photographic silver bromoiodide can be chemically sensitized by procedures and by compounds known in the photographic art. For example, the silver bromoiodide can be chemically sensitized with active gelatin, or with sulfur, selenium, tellurium, gold, platinum, palladium, iridium, osmium, rhodium, rhenium, or phosphorous sensitizers or combinations of these sensitizers, such as at pAg levels within the range of 5 to 10 and at pH levels within the range of 5 to 8 at temperatures within the range of 30° to 80° C. The silver bromoiodide can be chemically sensitized in the presence of finish, also known as chemical sensitization, modifiers, such as compounds known to suppress fog and increase speed during chemical sensitization, such a azaindenes, azapyridazines, azapyrimidines, benzothiazolium salts, and sensitizers having one or more heterocyclic nuclei. Optionally the silver bromoiodide can be reduction sensitized, such as with hydrogen, or through the use of reducing agents, such a stannous chloride, thiourea dioxide, polyamines or amineboranes.

The photographic silver bromoiodide emulsion can be spectrally sensitized by methods and compounds known in the photographic art. The photographic silver bromoiodide emulsion can be spectrally sensitized by, for example, dyes of a variety of classes, including the polymethine dye class, including cyanines, merocyanines, complex cyanines and merocyanines, oxonols, hemioxonols, styryls, merostyryls and streptocyanines. Combinations of spectral sensitizers are also useful.

The photographic silver bromoiodide emulsion of the invention can be used in ways, in photographic element formats and for purposes that silver bromoiodide emulsions have been used in the photographic art.

Photographic silver halide elements comprising a photographic silver bromoiodide emulsion as described can be either single color or multicolor elements. In a multicolor element, a cyan dye-forming coupler is typically associated with a red-sensitive emulsion, a magenta dye-forming coupler is typically associated with a green-sensitive emulsion and a yellow dye-forming coupler is associated with a blue-sensitive emulsion. Multicolor elements typically contain dye-forming units sensitive to each of the three primary regions of the spectrum. Each unit can comprise a single emulsion layer or multiple emulsion layers. The layers of the element and the image-forming units can be arranged in various orders as known in the photographic art.

The photographic element can contain added layers, such as filter layers, interlayers, overcoat layers, subbing layers and other layers known in the art.

In the following discussion of illustrative materials that are useful in elements of the invention reference will be made to *Research Disclosure*, December 1978, Item 17643, published by Kenneth Mason Publications Ltd., The Old Harbourmaster's, 8 North Street, Emsworth, Hampshire P010 7DD, England, the disclosures of which are incorporated by reference. The publication will be identified hereafter by the term "Research Disclosure".

Silver halide emulsions that can be employed in combination with the silver bromoiodide emulsion of the invention can be comprised of silver bromide, silver chloride, silver iodide, silver chloroiodide, silver chlorobromide or mixtures thereof. These silver halide emulsions can include silver halide grains of any conventional shape or size. Specifically the emulsions can be coarse, medium or fine grain. Tabular grain silver halide emulsions are useful in a photographic element as described. The silver halide emulsions that are useful with the silver bromoiodide emulsions of the invention can be polydisperse or monodisperse as precipitated. The grain size distribution of these emulsions can be controlled by silver halide grain separation techniques or by blending silver halide emulsions of differing grain sizes. For example, silver bromoiodide or silver bromides of different sizes of the same type and shape can be blended.

Any coupler known in the photographic art can be used with the silver bromoiodide emulsions as described. Examples of useful couplers are described in, for example, Research Disclosure Section VII, paragraphs D,E,F and G and in U.S. Pat. No. 4,433,048 and the publications cited therein. The couplers can be incorporated as described in Research Disclosure Section VII and the publications cited therein.

The photographic emulsions and elements can contain addenda known to be useful in the photographic art. The photographic emulsions and elements can contain brighteners (Research Disclosure Section V), antifoggants and stabilizers (Research Disclosure Section VI), antistain agents and image dye stabilizers (Research Disclosure Section VII, paragraphs I and J), light absorbing and scattering materials (Research Disclosure Section VIII), hardeners (Research Disclosure Section XI), plasticizers and lubricants (Research Disclosure Section XII), antistatic agents (Research Disclosure Section XIII), matting agents (Research Disclosure Section XVI) and development modifiers (Research Disclosure Section XXI).

The photographic elements can be coated on a variety of supports as described in Research Disclosure Section XVII and the references described therein.

The photographic elements can be exposed to actinic radiation, typically in the visible region of the spectrum, to form a latent image as described in Research Disclosure Section XVIII and then processed to form a visible image using processes and compositions known in the art, such as described in Research Disclosure Section XIX and U.S. Pat. No. 4,433,048 and the references described therein.

Processing of a color photographic element as described to form a visible dye image includes the step of contacting the element with a color photographic silver halide developing agent to reduce developable silver halide and oxidize the color developing agent. Oxidized color developing agent in turn reacts with at least one coupler to yield a dye.

Preferred color developing agents are p-phenylenediamines. Especially preferred are 4-amino-3-methyl-N,N-diethylaniline hydrochloride, 4-amino-3-methyl-N-ethyl-N-$\beta$-(methanesulfonamido)-ethylaniline sulfate hydrate, 4-amino-3-methyl-N-ethyl-N-$\beta$-hydroxyethylaniline sulfate, 4-amino-3-$\beta$-(methanesulfonamido)ethyl-N,N-diethyl-aniline hydrochloride and 4 -amino-N-ethyl-N-(2-methoxyethyl)-m-toluidine di-p-toluene sulfonic acid.

With the negative working silver bromoiodide emulsion of the invention this processing step leads to a negative image. To obtain a positive (or reversal) image, this step can be preceded by development with a non chromogenic developing agent to develop exposed silver halide, but not form dye, and then uniform fogging of the element to render unexposed silver halide developable.

Development is followed by conventional steps of bleaching, fixing, or bleach fixing, to remove silver and silver halide, washing and drying.

Improvements in sharpness can be obtained with a photographic silver halide emulsion and element as described comprising a photographic silver halide development inhibitor releasing compound or coupler (DIR compound). Any DIR compound known in the photographic art is useful with the photographic silver bromoiodide emulsion and element of the invention. Particularly useful DIR compounds are represented by the formula: CAR-TIME-INH wherein CAR is a carrier moiety, preferably a coupler moiety; TIME is a timing group; and INH is a development inhibitor moiety.

The DIR compounds that satisfy the formula CAR-TIME-INH are known in the art and are described in, for example, U.S. Pat. Nos. 4,248,962; 4,409,323; 4,684,604; 4,737,451; U.K. Pat. No. 2,099,167; and EP Published Applications 167,168 and 255,085, as well as U.S. Pat. Nos. 4,546,073; 4,564,587; 4,618,571, 4,698,297 and German OLS 3,307,506, the disclosures of which are incorporated herein by reference. Other useful DIR compounds are described in DeSelms and Kapecki U.S. patent application Ser. No. 074,582 filed July 17, 1987, now U.S. Pat. No. 4,782,012; Szajewski, Poslusny and Slusarek U.S. patent application Ser. No. 209,741 filed June 21, 1988 and Begley, Carmody and Buchanan patent applications Ser. No. 213,416, now U.S. Pat. No. 4,847,195, and 214,090, now U.S. Pat. No. 4,857,440, both filed June 30, 1988.

The carrier moiety (CAR) can be any moiety that, as a result of reaction with oxidized color developing agent, will release the timing group (TIME). Preferably the carrier is a coupler, but it can be another group, such as a hydrazide, a hydrazine or a hydroquinone. Coupler moieties can be a colored or colorless, diffusible or nondiffusible, reaction product with oxidized color developing agent.

When the carrier moiety is a coupler moiety, the DIR compounds are DIR couplers represented by the formula: COUP-TIME-INH wherein COUP is a coupler moiety.

Preferred timing groups (TIME) are described in U.S. Pat. Nos. 4,248,962 and 4,409,323 and European Patent Application 255,085.

The development inhibitor that is released from the DIR compound or coupler during processing of the element can be any of the development inhibitors known in the art. Illustrative INH moieties are mercaptotetrazoles, selenotetrazoles, mercaptobenzothiazoles, selenobenzothiazoles, mercaptobenzimidazoles, selenobenzimidazoles, mercaptobenzoxazoles, selenobenzoxazoles, benzotriazoles and benzodiazoles. Preferred are mercaptotetrazole inhibitors, benzotriazole inhibitors and oxadiazole inhibitors. Particularly preferred are those described in U.S. Pat. No. 4,477,563, U.K. Pat. No. 2,099,167 and U.S. patent application Ser. No. 074,582 filed July 17, 1987, now U.S. Pat. No. 4,782,012, the disclosures of which are incorporated herein by reference.

The following examples further illustrate the invention.

EXAMPLES 1 A-D

Emulsion A (Control)—Iodide introduced uniformly throughout the precipitation.

A monodispersed, cubic grain, silver bromoiodide (4M% I) emulsion having a grain size of 0.46 micron was prepared in the following manner:

Four solutions were prepared as follows:

| | |
|---|---|
| Solution 1: (Placed in the reaction vessel) | |
| Phthalated (7%) Gelatin | 768 g |
| Distilled Water | 24000 ml |
| Dissolved at 45° C. | |
| Solution 2: | |
| Sodium Bromide | 103 g |
| Distilled Water to | 1000 ml |
| Solution 3: | |
| Sodium Bromide | 3068 g |
| Potassium Iodide | 222.7 g |
| Distilled Water to | 16000 ml |
| Solution 4: | |
| Silver Nitrate | 5780 g |
| Distilled Water to | 17000 ml |

To Solution 1 were added 7.2 g of the silver halide ripening agent 1,8-dihydroxy-,6-dithiooctane, in 352 ml of distilled water, and the pBr was adjusted to 3.2 with Solution 2; Solutions 3 and 4 were then simultaneously run into Solution 1 over a 50 minute period, with continuous agitation, using an accelerated flow double jet technique (20 minutes at 140 ml/minute, 10 minutes at 240 ml/minute, and 20 minutes at 456 ml/ minute), maintaining the temperature at 45° C. and the pBr at 3.2. Following the precipitation the emulsion was washed using the procedure described in Example 3 of U.S. Pat. No. 2,614,929.

Emulsions B, C and D (Illustrate the Invention)

Emulsion B—(Iodide introduced uniformly in the first 90% of the precipitation)

A monodispersed, cubic grain, silver bromoiodide (4M% I) emulsion of the invention having a grain size of 0.47 micron was prepared in the following manner:

Five solutions were prepared as follows:

| | |
|---|---|
| Solution 1B: (Placed in the reaction vessel) | |
| Phthalated (7%) Gelatin | 240 g |
| Distilled Water to | 7500 ml |
| Dissolved at 45° C. | |
| Solution 2B: | |
| Sodium Bromide | 926 g |
| Potassium Iodide | 69.3 g |
| Distilled Water to | 4750 ml |
| Solution 3B: | |
| Sodium Bromide | 152 g |
| Distilled Water to | 750 ml |
| Solution 4B: | |
| Silver Nitrate | 1700 g |
| Distilled Water to | 4500 ml |
| Solution 5B: | |
| Silver Nitrate | 170 g |
| Distilled Water to | 500 ml |

To Solution 1B were added 2.25 g of 1,8-dihydroxy-3,6-dithiooctane, in 100 ml of distilled water, and the pBr was adjusted to 3.2, using Solution 3B. Solutions 2B and 4B were then simultaneously run in to Solution 1B over a 55 minute period, with continuous agitation, using an accelerated flow double jet technique (20 minutes at 45 ml/minute, 10 minutes at 80 ml/minute, and 25 minutes at 140 ml/minute), maintaining the temperature at 45° C. and the pBr at 3.2. The resulting composition was held for two minutes and then the precipitation was continued by simultaneously adding solution 3B and 5B for 7 minutes at a rate of 70 ml/minute, maintaining the temPerature at 45° C. and the PBr at 3.2. Following the precipitation the emulsion was washed using the procedure described in Example 3 of U S. Pat. No. 2,614,929.

Emulsion C—(Iodide introduced uniformly in the first 80% of the precipitation)

A monodispersed, cubic grain, silver bromoiodide (4M% I) emulsion of the invention, having a grain size of 0.49 micron, was prepared as follows:

Five solutions were prepared as follows:

| | |
|---|---|
| Solution 1C: (Placed in the reaction vessel) | |
| Phthalated (7%) Gelatin | 240 g |
| Distilled Water | 7500 ml |
| Dissolved at 45° C. | |
| Solution 2C: | |
| Sodium Bromide | 824 g |
| Potassium Iodide | 69.3 g |
| Distilled Water to | 4250 ml |
| Solution 3C: | |
| Sodium Bromide | 255 g |
| Distilled Water to | 1250 ml |
| Solution 4C: | |
| Silver Nitrate | 863 g |
| Distilled Water to | 4000 ml |
| Solution 5C: | |
| Silver Nitrate | 342 g |
| Distilled Water to | 1000 ml |

To Solution 1C were added 2.25 g of 1,8-dihydroxy-3,6-dithiooctane, in 100 ml of distilled water. The pBr of the solution was then adjusted to 3.2 using Solution 3C. Solutions 2C and 4C were then simultaneously run into Solution 1C over a 55 minute period, with continuous agitation using an accelerated flow double jet technique (20 minutes at 45 ml/minute, 10 minutes at 80 ml/minute, and 25 minutes at 140 ml/minute) while maintaining the temperature at 45° C. and the PBr at 3.2. The resulting composition was then held for 2 minutes and then the precipitation was continued by simultaneously adding Solutions 3C and 5C for 14 minutes at a rate of 70 ml/minute while maintaining the temperature at 45° C. and the pBr at 3.2. Following the precipitation the emulsion was washed using the procedure described in Example 3 of U.S. Pat. No. 2,614,929.

Emulsion D—(Iodide uniformly introduced during the first 70% of the precipitation.)

A monodispersed, cubic grain silver bromoiodide (4M% I) emulsion of the invention having a grain size of 0.48 micron was prepared as follows:

Five solutions were prepared as follows:

| | |
|---|---|
| Solution 1D: (Placed in the reaction vessel) | |
| Phthalated (7%) Gelatin | 240 g |
| Distilled Water | 7500 ml |
| Dissolved at 45° C. | |
| Solution 2D: | |
| Sodium Bromide | 721 g |
| Potassium Iodide | 70.6 g |
| Distilled Water to | 3750 ml |
| Solution 3D: | |
| Sodium Bromide | 357 g |
| Distilled Water to | 1750 ml |
| Solution 4D: | |
| Silver Nitrate | 1196 g |
| Distilled Water to | 3500 ml |
| Solution 5D: | |
| Silver Nitrate | 513 g |
| Distilled Water to | 1500 ml |

To Solution 1D were added 2.25 g of 1,8-dihydroxy-3,6-dithiooctane, in 100 ml of distilled water. Then the pBr was adjusted to 3.2 using Solution 3D. Solution 2D and 4D were then simultaneously run into Solution 1D over a 55 minute period, with continuous agitation, using an accelerated flow double jet technique (20 minutes at 45 ml/minute, 10 minutes at 80 ml/minute, and 25 minutes at 140 ml/minute) while maintaining the temperature at 45° C. and the pBr at 3.2. The resulting composition was then held for 2 minutes. Then the precipitation was continued by simultaneously adding Solutions 3D and 5D for 21 minutes, at a rate of 70 ml/minute, while maintaining the temperature at 45° C. and the pBr at 3.2. Following the precipitation the emulsion was washed using the procedure described in Example 3 of U.S. Pat. No. 2,614,929.

The resulting emulsions were analyzed using an x-ray diffraction technique to determine the iodide distribution within the grains. All the above emulsions were found to have a bulk iodide content of about 4 mole percent which was substantially uniformly distributed throughout the structure of each individual grain.

The series of monodispersed, cubic grain silver bromoiodide emulsions described above were optimally sulfur and gold chemically sensitized and then spectrally sensitized to the green region of the visible spectrum. The emulsions were separately coated in a single layer magenta dye forming format on a cellulose triacetate film support. Each of the coated elements comprised the respective emulsion at 0.80 g/m, gelatin at 1.59 g/m, a solvent dispersion of the magenta dye image-forming coupler 7-chloro-3-[3-(4-[2-[4-(p-hydroxyphenylsulfonyl)phenoxy]dodecanamido]-phenyl)-propyl]-6-methyl-H-pyrazolo-[3,2-c-]-s-triazole at 0.65 g/m and the DIR coupler 1-[4-[alpha-(2,4-di-tert-amylphenoxy)butyramido]phenyl-3-pyrrolidino-4-(1-phenyl-5-tetrazolylthio)-5-pyrazolone at 0.027 g/m. An overcoat layer comprising gelatin at 4.3 g/m and the hardener bis(vinylsulfonylmethyl)ether at 1.75% based on the total gelatin weight was applied.

The resulting photographic elements were imagewise exposed at 1/25 of a second through a 0–4.0 density step tablet plus a Wratten No.9 filter (Wratten is a trademark of Eastman Kodak Co., U.S.A.) to a 600W, 5500 K tungsten light source. Processing was accomplished at 37.7° C. in a color process of the type described in the British Journal of Photography Annual 1979, pages 204–206, at a development time of 3 minutes and 15 seconds. The sensitometric curves obtained were plotted and the exposure latitude provided by the individual emulsions was then determined by measuring the exposure range contained within the straight line portion of the sensitometric curve. The exposure latitude results are given in the following Table A:

TABLE A

| Emulsion | Iodide Introduction During Precipitation | Latitude Log E |
|---|---|---|
| A (Control) | Uniformly throughout | 1.10 |
| B (Invention) | Within first 90% only | 1.40 |
| C (Invention) | Within first 80% only | 1.35 |
| D (Invention) | Within first 70% only | 1.25 |

The results in Table A demonstrate that the emulsions and elements of the invention in B, C and D provide significantly longer exposure latitude than the control emulsion and element of A.

The invention has been described in detail with particular reference to preferred embodiments thereof, but it will be understood that variations and modifications can be effected within the spirit and scope of the invention.

What is claimed is:

1. A photographic silver halide emulsion comprising a dispersing medium and silver bromoiodide that (a) is monodispersed, cubic grain silver bromoiodide;

(b) has a grain size within the range of 0.1 to 0.7 micron;

(c) contains 1 to 7 mole percent iodide; and (d) is prepared by a process comprising (i) forming the silver bromoiodide grains by mixing, in the presence of a thioether ripening agent, silver salt and alkali metal bromide and iodide salts until 60 to 90% of the silver salt has been added; then, (ii) carrying out the remainder of the silver bromoiodide grain formation with the addition of silver salt and alkali metal bromide salts wherein in (ii) no iodide salts are added;

wherein the resulting silver bromoiodide grains have no discernible shell as analyzed by x-ray diffraction.

2. A photographic silver halide emulsion as in claim 1 wherein the iodide concentration in the grain is substantially evenly distributed in the grain.

3. A photographic silver halide emulsion as in claim 1 wherein the dispersing medium is comprised of a peptizer.

4. A photographic silver halide emulsion as in claim 1 wherein the dispersing medium is gelatin or a gelatin derivative.

5. A photographic silver halide emulsion as in claim 1 wherein the ripening agent is 1,8-dihydroxy-3,6-dithiooctane.

6. A photographic silver halide emulsion as in claim 1 wherein during the process (d) a pBr within the range of 2.5 to 6 is maintained and the process is carried out at a temperature within the range of 25° to 80° C.

7. A photographic silver halide emulsion as in claim 1 comprising a photographic silver halide development inhibitor releasing compound or coupler added to the emulsion after (d).

8. A photographic silver halide element comprising a support bearing at least one photographic silver halide emulsion layer comprising a photographic silver bromoiodide emulsion as defined in claim 1.

9. A photographic silver halide element as in claim 8 that is a color photographic silver halide element.

10. A multicolor photographic silver halide element comprising a support bearing emulsion layers for separately recording blue, green and red light wherein at least one of the layers comprises a photographic silver bromoiodide emulsion as defined in claim 1.

11. A photographic silver halide element as in claim 11 comprising at least one blue sensitive layer containing at least one yellow dye image forming coupler, at least one green sensitive layer containing at least one magenta dye image forming coupler, and at least one red sensitive layer containing at least one cyan dye image forming coupler.

12. A photographic silver halide element as in claim 10 comprising at least one photographic silver halide development inhibitor releasing compound or coupler.

13. A process of forming a visible photographic image in an exposed photographic silver halide element as defined in claim 8 comprising developing the element in an aqueous alkaline solution in the presence of photographic silver halide developing agent.

14. A process of forming a visible photographic image in an exposed color photographic silver halide element as defined in claim 10 comprising developing the element in an alkaline processing solution in the presence of a color photographic silver halide developing agent.

15. A method of preparing a monodispersed, cubic grain silver bromoiodide emulsion wherein the silver bromoiodide grains have a grain size within the range of 0.1 to 0.7 micron and contain 1 to 7 mole percent iodide;

comprising (i) forming the silver bromoiodide grains by mixing, in the presence of a thioether ripening agent, silver salt and alkali metal bromide and iodide salts until 60 to 90% of the silver salt has been added;

then, (ii) carrying out the remainder of the silver bromoiodide grain formation with the addition of silver salt and alkali metal bromide salts wherein in (ii) no iodide salts are added; wherein the resulting silver bromoiodide grains have no discernible shell as analyzed by x-ray diffraction.

16. A method as in claim 15 wherein in (i) and (ii) a pBr within the range of 2.5 to 6 is maintained and the temperature is maintained within the range of 25° to 80° C.

17. A method as in claim 15 wherein the ripening agent is 1,8-hydroxy-3,6-dithiooctane.

18. A method of preparing a monodispersed, cubic grain, silver bromoiodide gelatino emulsion wherein the silver bromoiodide grains have a grain size within the range of 0.1 to 0.7 micron and contain 1 to 7 mole percent iodide;

comprising (i) forming the silver bromoiodide grains by mixing, in the presence of 1,8-hydroxy-3,6-dithiooctane, silver nitrate, sodium bromide and potassium iodide until 60 to 90% of the silver nitrate is added;

then, (ii) carrying out the remainder of the silver bromoiodide grain formation with the addition of silver nitrate and sodium bromide, without addition of iodide salt; wherein the resulting silver bromoiodide grains have no discernible shell as analyzed by x-ray diffraction.

* * * * *